US007662080B2

(12) United States Patent
Kapturowski et al.

(10) Patent No.: US 7,662,080 B2
(45) Date of Patent: Feb. 16, 2010

(54) CREASE ROLLER APPARATUSES AND METHODS FOR USING SAME

(75) Inventors: Edward J. Kapturowski, Apex, NC (US); Robert T. Snyder, Raleigh, NC (US)

(73) Assignee: Bowe Bell & Howell, Durham, NC (US)

( * ) Notice: Subject to any disclaimer, the term of this patent is extended or adjusted under 35 U.S.C. 154(b) by 284 days.

(21) Appl. No.: 11/546,555

(22) Filed: Oct. 12, 2006

(65) Prior Publication Data

US 2008/0090713 A1 Apr. 17, 2008

(51) Int. Cl.
*B31F 1/00* (2006.01)

(52) U.S. Cl. ..... 493/403; 271/2

(58) Field of Classification Search ..... 271/2; 493/403, 464

See application file for complete search history.

(56) References Cited

U.S. PATENT DOCUMENTS 1,000,139 A * 8/1911 Wyman ..... 493/396
1,196,912 A * 9/1916 Weck ..... 493/396
2,668,053 A 2/1954 Bach
3,207,017 A 9/1965 McCain et al.
3,275,118 A 9/1966 McCain et al.
3,545,371 A * 12/1970 Reist ..... 100/176
3,717,074 A * 2/1973 Rasmussen ..... 493/403
4,071,997 A 2/1978 Gunther, Jr. et al.
4,078,790 A 3/1978 Stocker
4,089,378 A * 5/1978 Suzuki ..... 169/54
4,217,085 A 8/1980 Ljungberg et al.
4,299,073 A 11/1981 Golicz et al.
4,524,691 A 6/1985 Miller
4,541,764 A 9/1985 Govan et al.
4,604,849 A 8/1986 Zemke et al.
4,694,631 A 9/1987 Gunther, Jr.
4,694,632 A 9/1987 Gunther, Jr.
4,753,429 A 6/1988 Irvine et al.
4,775,143 A 10/1988 Arnoldi et al.
4,787,192 A 11/1988 Gunther, Jr.
4,958,063 A 9/1990 Hausmann
5,100,125 A 3/1992 Uplinger et al.
5,112,291 A 5/1992 VerMehren
5,123,891 A * 6/1992 Nieradka et al. ..... 493/370
5,125,214 A 6/1992 Orsinger et al.

(Continued)

FOREIGN PATENT DOCUMENTS

DE 3409168 9/1985

(Continued)

OTHER PUBLICATIONS

Partial European Search Report issued in European Patent Application No. EP 07 01 7898, dated Feb. 13, 2008.

(Continued)

*Primary Examiner*—Kaitlin S Joerger
(74) *Attorney, Agent, or Firm*—Jenkins, Wilson, Taylor & Hunt, P.A.

(57) ABSTRACT

Apparatuses and methods are provided for improving handling of sheet articles during processing within sheet or mail processing machines, particularly for causing creased sheet articles to assume a more planar position within a sheet or mail processing machine. Rollers may be provided for bending a crease of a sheet article along its crease.

18 Claims, 9 Drawing Sheets

U.S. PATENT DOCUMENTS

| | | | | | |
|---|---|---|---|---|---|
| 5,154,410 | A | * | 10/1992 | Baader et al. | 271/188 |
| 5,158,525 | A | * | 10/1992 | Nikkel | 493/471 |
| 5,230,504 | A | | 7/1993 | Schmaling | |
| 5,255,498 | A | | 10/1993 | Hotchkiss et al. | |
| 5,414,977 | A | | 5/1995 | Cohen | |
| 5,415,068 | A | | 5/1995 | Marzullo | |
| 5,417,414 | A | | 5/1995 | Belec et al. | |
| 5,449,159 | A | | 9/1995 | Belec et al. | |
| 5,524,417 | A | | 6/1996 | Iddon | |
| 5,581,972 | A | | 12/1996 | Antonelli | |
| 5,737,899 | A | | 4/1998 | Supron et al. | |
| 5,802,808 | A | | 9/1998 | Lyga | |
| 5,848,518 | A | | 12/1998 | Bufalini et al. | |
| 5,860,643 | A | | 1/1999 | Moser et al. | |
| 5,888,183 | A | * | 3/1999 | Ruthenberg et al. | 493/366 |
| 6,041,569 | A | | 3/2000 | Freeman et al. | |
| 6,106,452 | A | * | 8/2000 | Baumuller | 493/464 |
| 6,131,722 | A | * | 10/2000 | Button et al. | 198/575 |
| 6,182,962 | B1 | | 2/2001 | Leuthold | |
| 6,341,773 | B1 | | 1/2002 | Aprato et al. | |
| 6,371,902 | B1 | | 4/2002 | Bluemle | |
| 6,398,204 | B1 | | 6/2002 | Keane et al. | |
| 6,446,955 | B1 | | 9/2002 | Janatka et al. | |
| 6,572,519 | B1 | * | 6/2003 | Harris | 493/395 |
| 6,615,105 | B2 | | 9/2003 | Masotta | |
| 6,783,489 | B1 | * | 8/2004 | Ratzel et al. | 493/464 |
| 6,915,184 | B2 | | 7/2005 | Yates et al. | |
| 6,957,521 | B2 | | 10/2005 | Botschek et al. | |
| 7,021,184 | B2 | | 4/2006 | Sussmeier et al. | |
| 7,220,093 | B2 | | 5/2007 | Overman et al. | |
| 7,396,006 | B2 | | 7/2008 | Kapturowski et al. | |
| 2003/0014376 | A1 | | 1/2003 | DeWitt et al. | |
| 2004/0035527 | A1 | | 2/2004 | Cook | |
| 2004/0255561 | A1 | | 12/2004 | Heilman | |
| 2005/0189409 | A1 | | 9/2005 | Conard et al. | |
| 2006/0116263 | A1 | * | 6/2006 | Rathbun et al. | 493/59 |
| 2007/0075475 | A1 | | 4/2007 | Kapturowski et al. | |
| 2007/0145659 | A1 | | 6/2007 | Kapturowski et al. | |
| 2007/0164496 | A1 | * | 7/2007 | Kapturowski et al. | 270/52.01 |
| 2008/0086983 | A1 | | 4/2008 | Kapturowski et al. | |
| 2008/0088076 | A1 | | 4/2008 | Shinn et al. | |
| 2008/0088083 | A1 | | 4/2008 | Kapturowski et al. | |

FOREIGN PATENT DOCUMENTS

| | | | |
|---|---|---|---|
| DE | 38 11 221 | A1 | 10/1989 |
| DE | 3811221 | | 10/1989 |
| DE | 3938530 | | 8/1990 |
| DE | 19543634 | | 5/1997 |
| DE | 102 08 583 | A1 | 10/2002 |
| DE | 10208583 | | 10/2002 |
| DE | 20320537 | | 10/2004 |
| EP | 0113011 | | 7/1984 |
| EP | 0220124 | | 4/1987 |
| EP | 1770042 | | 4/2007 |
| EP | 17700042 | | 4/2007 |
| EP | 1911602 | | 4/2008 |
| EP | 1911703 | | 4/2008 |
| EP | 1911704 | | 4/2008 |
| EP | 1911708 | | 4/2008 |
| EP | 1911710 | | 4/2008 |
| FR | 2587015 | | 3/1987 |
| GB | 2 347 897 | | 9/2000 |
| GB | 2347897 | | 9/2000 |
| GB | 2 399 056 | | 9/2004 |
| GB | 2399056 | | 9/2004 |
| JP | 61295934 | | 12/1986 |
| JP | 8-207177 | | 8/1996 |
| JP | 08207177 | A | 8/1996 |
| WO | WO 98/46420 | | 10/1998 |
| WO | WO98/46420 | | 10/1998 |
| WO | WO01/56712 | | 8/2001 |

OTHER PUBLICATIONS

Extended European Search Report for EP Application No. 07017898.3 dated Feb. 24, 2009.

European Search Report for application EP06018903 dated Mar. 13, 2007.

Extended European Search Report for EP07017896 dated Feb. 22, 2008.

Extended European Search Report for EP07017894 dated Feb. 28, 2008.

Extended European Search Report dated Jan. 31, 2008 for EP 07020043.1-2211.

Office Action-non final action dated Jun. 18, 2008 for U.S. Appl. No. 11/546,552.

Office Action Restriction Requirement dated Oct. 30, 2007 for U.S. Appl. No. 11/546,556.

Office Action-non final action dated Jan. 10, 2008 for U.S. Appl. No. 11/546,556.

Notice of Allowance dated Jul. 14, 2008 for U.S. Appl. No. 11/546,556.

Office Action-non final action dated Sep. 25, 2007 for U.S. Appl. No. 11/240,604.

Notice of Allowance dated Dec. 11, 2007 for U.S. Appl. No. 11/240,604.

Patent Withdrawal Notice dated Mar. 28, 2008 for U.S. Appl. No. 11/240,604.

Notice of Allowance dated Apr. 24, 2008 for U.S. Appl. No. 11/240,604.

* cited by examiner

CREASE ROLLER APPARATUSES AND METHODS FOR USING SAME

RELATED APPLICATIONS

This application relates to U.S. patent application Ser. No. 11/546,535, entitled "INSERTER SYSTEMS AND METHODS" filed simultaneously, the disclosure of which is incorporated herein by reference in its entirety. Further, this application relates to U.S. patent application Ser. No. 11/546,556, entitled "APPARATUSES AND METHODS FOR VARIABLY OPENING ENVELOPES", and to U.S. patent application Ser. No. 11/546,553, entitled "APPARATUSES AND METHODS FOR REGISTERING SHEET ARTICLES," also filed simultaneously, the disclosures of which are also incorporated herein by reference in their entireties.

TECHNICAL FIELD

The subject matter disclosed herein relates generally to handling of sheet articles for processing. More particularly, the subject matter disclosed herein relates to apparatuses and methods for causing creased sheet articles to assume a more planar position within a sheet processing machine.

BACKGROUND

Increasingly, a widespread need exists in commercial and governmental institutions for sheet processing machines, particularly mail processing machines, capable of operating at higher operation speeds with high reliabilities and short down-times. Operating sheet processing machines at or near their maximum capability is critical for optimizing output and throughput. Delays or inefficiencies in any operation in the processing of sheet articles can undesirably affect further operations downstream. Since each operation is typically synchronized to the others, delays in feeding time, as well as other operations, can be perpetuated throughout an entire sheet processing sequence or line.

Speeds and efficiencies of a sheet processing machine in high speed operations can be greatly affected by the handling of the sheet articles within the sheet processing machine. For example, demands on accuracy of sheet article positioning and alignment in the course of handling of sheet articles are greatly increased in high speed sheet or mail processing machines. False or inadequate alignment or registrations can result in misfeeds of sheet articles that can cause delays in processing.

A further example relates to processing of creased sheet articles. When processing creased sheet articles within a sheet processing machine, particular attention needs to be paid to the handling of the creased sheet articles. The crease of a sheet article can cause the sheet article to assume a non-planar position. Thus, the creased sheet article may become harder to process within a sheet processing machine. When filling an envelope within an inserter system, for example, the fold of the flap of the envelope along its hinge line often causes the envelope to assume a non-planar position, which makes handling within the inserter system more difficult. Also, the fold of the flap often causes the flap to block the mouth of the envelope. Thus, it is desirable to have the envelope assume a more planar position during processing within a sheet processing machine. Complicated mechanisms are currently used within sheet processing machines to force envelopes to assume a more planar position during processing. These mechanisms used to force envelopes to assume a more planar position during processing can slow down processing and also cause delays and inefficiencies.

Another example of where the handling of sheet articles within an inserter system can affect delays or inefficiencies relates to the filling of envelopes. The processes and apparatuses used for opening envelopes can create a bottle neck within an inserter system. Any delays or inefficiencies in such processes or apparatuses will likely affect production through the entire inserter system. Thus, any improvement in speeds or efficiencies can greatly affect production of the inserter system. For example, early steps for preparing the envelopes for insertion may be beneficial. Also, processing the envelope in a more effective manner can improve throughput of the inserter system. For instance, maximizing the amount that an envelope is held open is desirable to prevent unneeded contraction of the sides of the envelope that can result in misfeeds of insert material, while still holding the envelope opened wide enough to permit the filling of the envelope. Such an improvement could increase efficiencies in insertion of insert material into envelopes.

In light of the above, needs exist for improved handling of sheet articles within sheet processing systems, such as mail processing systems, particularly with regard to improving throughput and increasing efficiencies within a sheet processing machine.

SUMMARY

In accordance with this disclosure, novel apparatuses and methods are provided for improving handling of sheet articles during processing within sheet or mail processing machines, particularly for causing creased sheet articles to assume a more planar position within a sheet or mail processing machine. Rollers may be provided for bending a crease of a sheet article.

Some of the objects having been stated hereinabove and are addressed in whole or in part by the present subject matter. Other objects will become evident as the description proceeds when taken in connection with the accompanying drawings as best described hereinbelow.

BRIEF DESCRIPTION OF THE DRAWINGS

A full and enabling disclosure of the present subject matter including the best mode thereof to one of ordinary skill of the art is set forth more particularly in the remainder of the specification, including reference to the accompanying figures, in which.

DETAILED DESCRIPTION

Reference will now be made in detail to presently preferred embodiments of the present subject matter, one or more examples of which are shown in the various figures. Each example is provided to explain the subject matter and not as a limitation. In fact, features illustrated or described as part of one embodiment can be used in another embodiment to yield still yet another embodiment. It is intended that the present subject matter covers such modifications and variations.

The term "sheet article" is used herein to designate any sheet article, and can include, for example and without limitation, envelopes, sheet inserts folded or unfolded for insertion into an envelope or folder, and any other sheet materials.

The term "mail article" is used herein to designate any article for possible insert into a mailing package, and can include, for example and without limitation, computer disks, compact disks, promotional items, or the like, as wells any sheet articles.

The term "document set" is used herein to designate one or more sheet articles and/or mail articles grouped together for processing.

As defined herein, the term "insert material" can be any material to be inserted into an envelope, and can include, for example and without limitation, one or more document sets, sheet articles, mail articles or combinations thereof.

Figure 1:
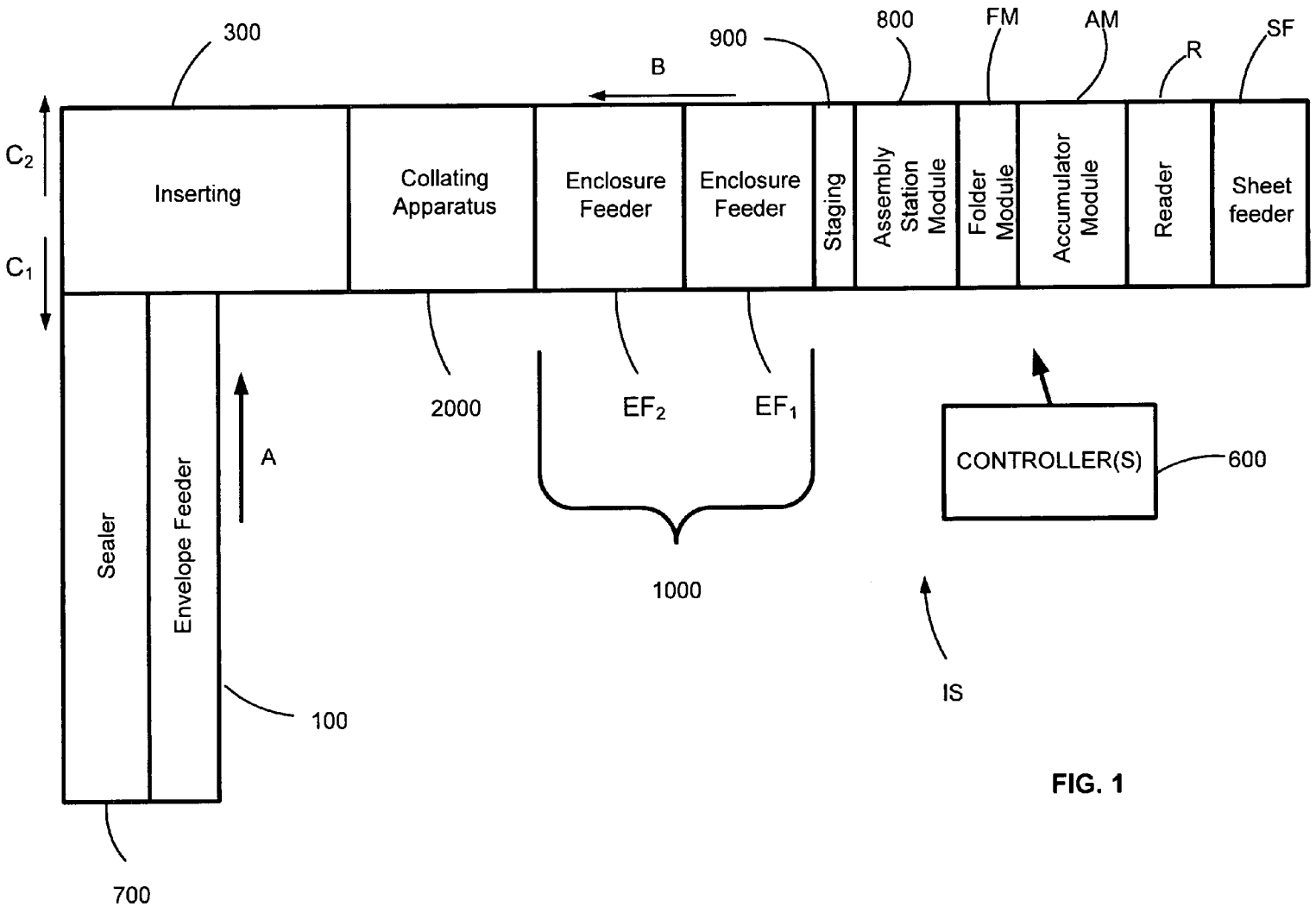
FIG. 1 illustrates a schematic view of an embodiment of an inserter system that can employ an embodiment of the present subject matter.

The present subject matter relates to sheet processing, such as, for example, mail inserting systems, mail sorting systems, and any other sheet processing systems. For example, FIG. 1 illustrates a plan schematic view of an inserter system, generally designated IS. The inserter system IS can comprise different modules that can be assembled in different arrangements for inserting material into envelopes. The different modules and inserter system IS can be controlled by a controller 600. The controller 600 can be computer hardware or software. For example, the controller 600 can include one or more computers, mini-computers, programmable logic controllers or the like.

Inserter system IS can include, for example, an envelope feeder module, generally designated as 100, which feeds envelopes in a direction A into an inserting station module, generally designated as 300. An assembly station module 800 can be used to collect one or more sheet articles and/or one or more mail articles from upstream into a first document set that can be sent to a staging station 900 before being conveyed in a direction B toward inserting station module 300. In front of or behind each first document set on a conveying path of the inserter system IS, one or more sheet articles and/or mail articles can be fed on the conveying path to form second document sets as the first document sets move in the direction B so that each first document set and corresponding second document sets can be combined together into insert material for insertion into an envelope.

The second document sets are fed into the conveying path to be combined with the first document sets by one or more modules 1000 of enclosure feeders $EF_1$, $EF_2$. Each enclosure feeder module $EF_1$, $EF_2$ can include one or more station feeders for providing second document sets to be included in insert material to fill the envelope. Enclosure feeders $EF_1$, $EF_2$ can feed second document sets in front of the first document set or behind the first document set. Further, enclosure feeders $EF_1$, $EF_2$ can feed sheet articles and/or mail articles on top of the first document set.

In the examples shown, a collating apparatus module 2000, as shown and described in U.S. patent application Ser. No. 11/240,604, filed Sep. 30, 2005, the disclosure of which is incorporated herein by reference in its entirety, can be provided to collate the first and second document sets together before being feed to inserting station module 300 where the material can then be placed into an envelope. Each filled envelope can then be directed in direction $C_1$ into a sealer module 700 after insertion has occurred. The envelopes can be sealed in the sealer module 700 before they are sent out for metering and mailing. Further, the inserting station module can include an apparatus for diverting defects in a direction $C_2$ put of the inserter system IS.

Other modules can be included in the inserter system IS. For example, a sheet feeder SF for feeding in sheet articles to be collected in the assembly station 800 is normally positioned upstream of the assembly station 800. Assembly station 800 can be followed by staging station 900. Further, other modules can be placed inside the inserter system IS such as a folder module FM, accumulator module AM and reader module R as are commonly used within the art. These modules can be placed anywhere within inserter system IS where they may be needed for a desired use.

Reader module R can be used to read and collect information from sheets passing under it, for example, from bar codes. Reader module R can be in direct communication with controller 600. Reader module R can read information from sheet articles and/or mail articles to be used by controller 600 to control insertion system IS. The information read by reader module R can help determine how a grouping of sheet articles and/or mail articles in a document set will be processed within inserter system IS. Further, the information can be used to determine what other document sets may be needed in the insert material for any particular envelope. Accordingly, the information can also be used to determine the amount of insert material to be received in each envelope.

According to certain aspects of the present subject matter, a crease roller apparatus is provided. The crease roller apparatus can include a first roller having a circumferential perimeter surface. The first roller can have a ridge extending at least partially around the circumferential perimeter surface of the first roller. The crease roller apparatus can also include a second roller having a circumferential perimeter surface. The second roller can have a channel extending at least partially around the circumferential perimeter surface of the second roller. The first and second rollers can be oriented to align the circumferential perimeter surface of the first roller with the circumferential perimeter surface of the second roller. The ridge of the first roller can extend into the channel of the second roller such that a sheet article with a crease can pass between the first and second rollers.

According to other certain aspects of the present subject matter, a method for bending a crease of a sheet article is provided. The method includes providing a sheet article with a crease. The sheet article can then be fed between a pair of rollers where the crease passes between a ridge of a first roller and a channel of a second roller to bend the crease of the sheet article.

Figure 2A:
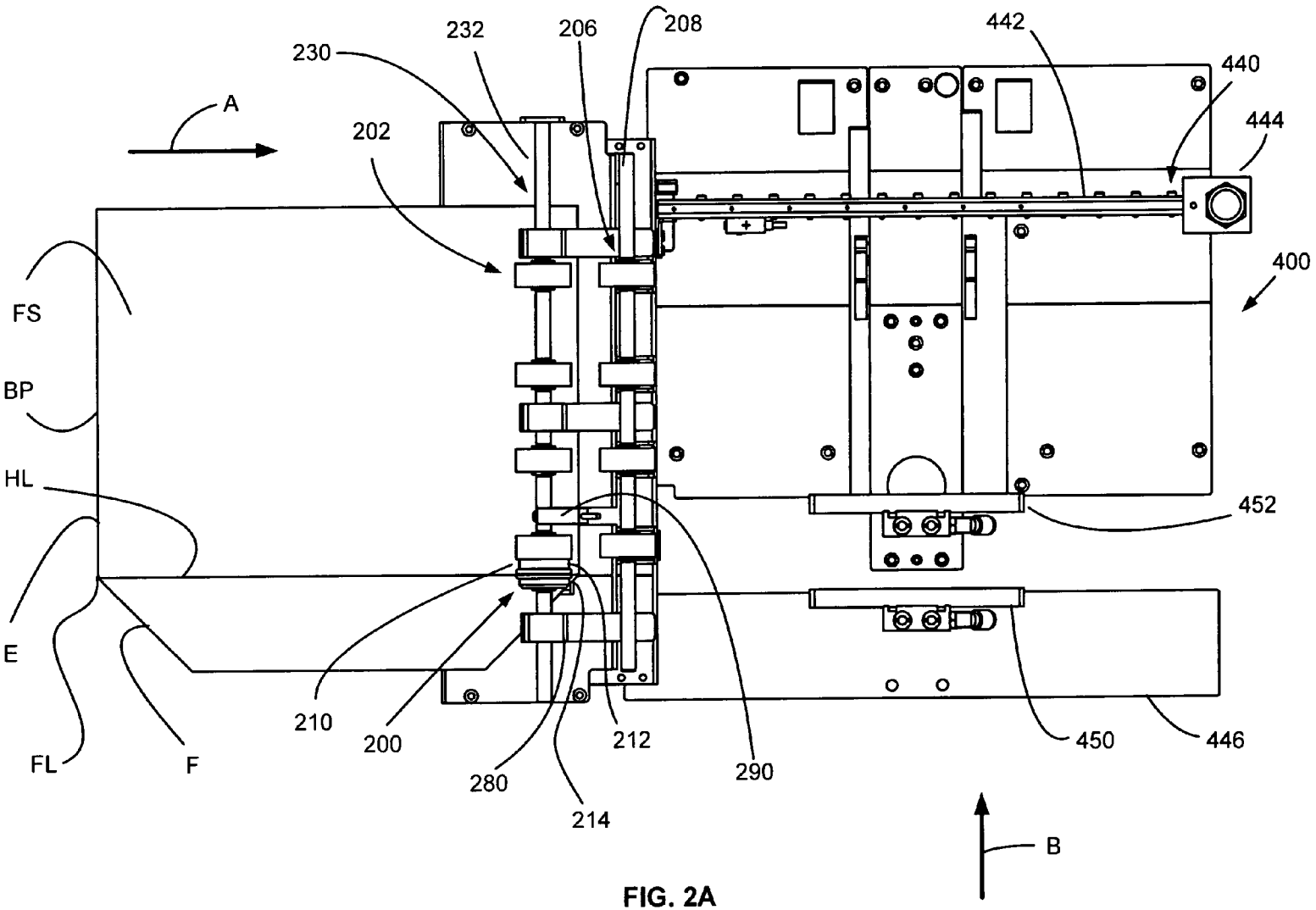
FIG. 2A illustrates a top plan view of an envelope entering a crease roller apparatus according to the present subject matter.
Figure 2B:
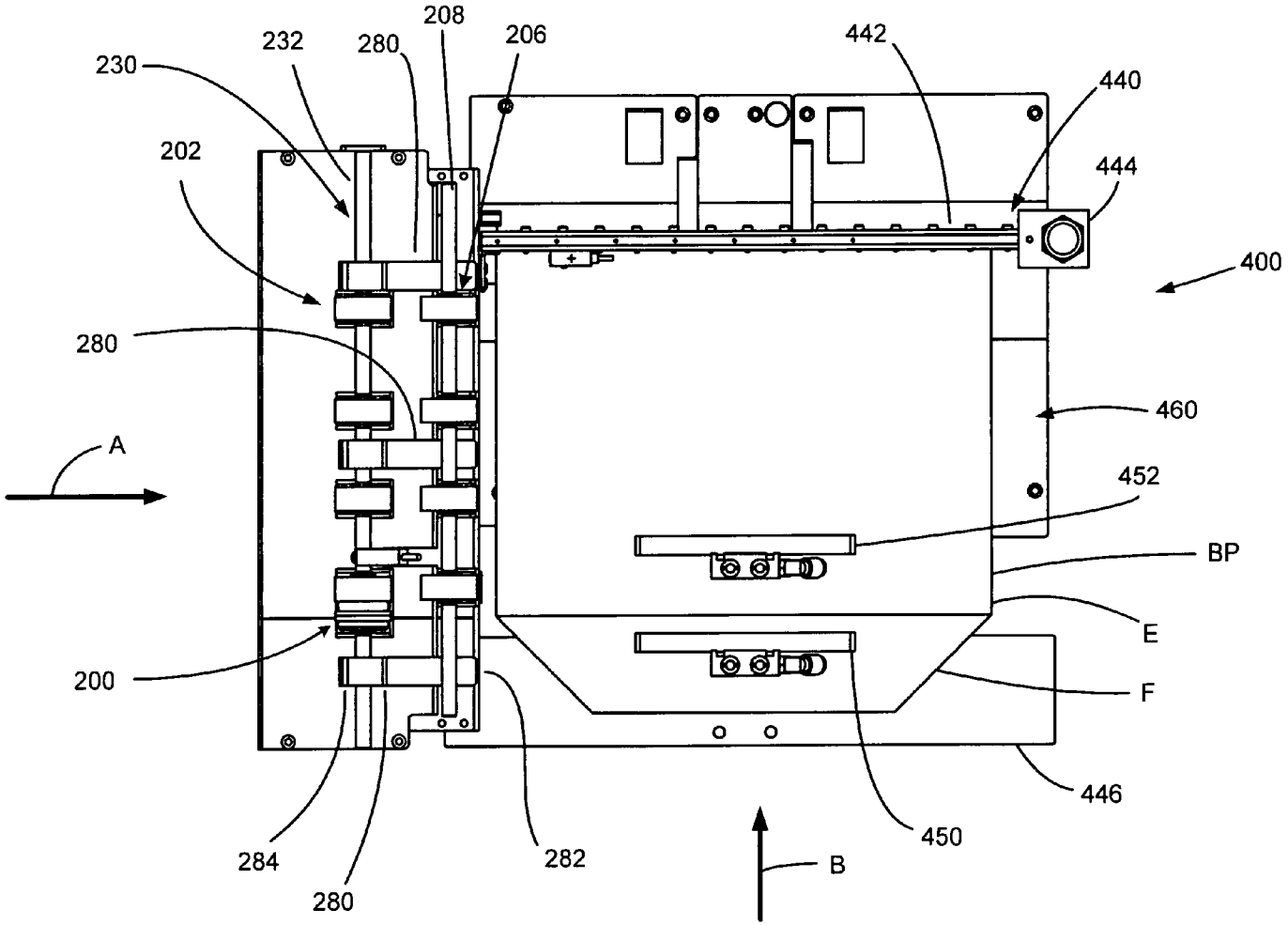
FIG. 2B illustrates a top plan view of the envelope residing in the registration apparatus according to FIG. 2A.
Figure 3:
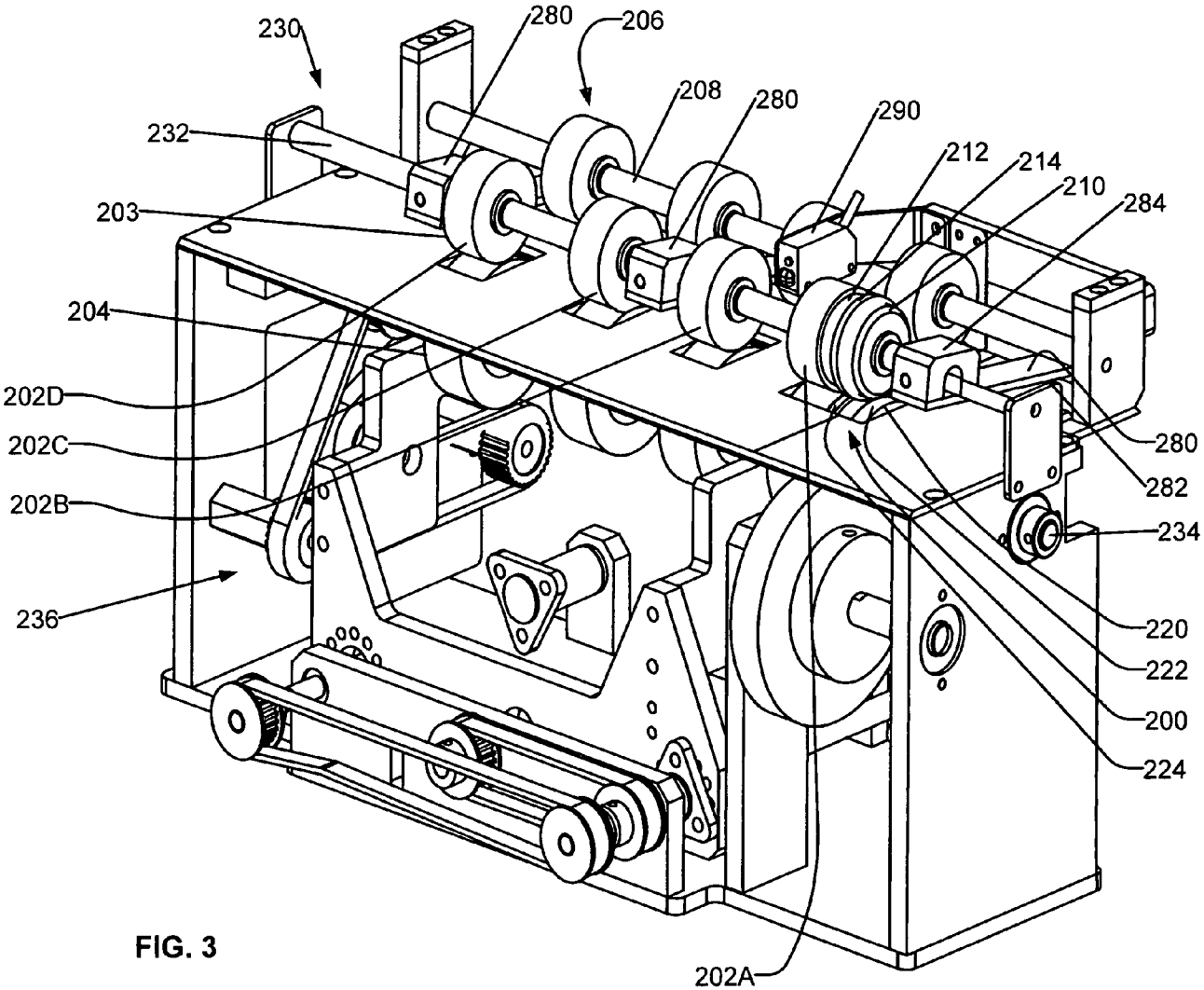
FIG. 3 illustrates a perspective view of the embodiment of the crease roller apparatus according to FIG. 2A.
Figure 4A:
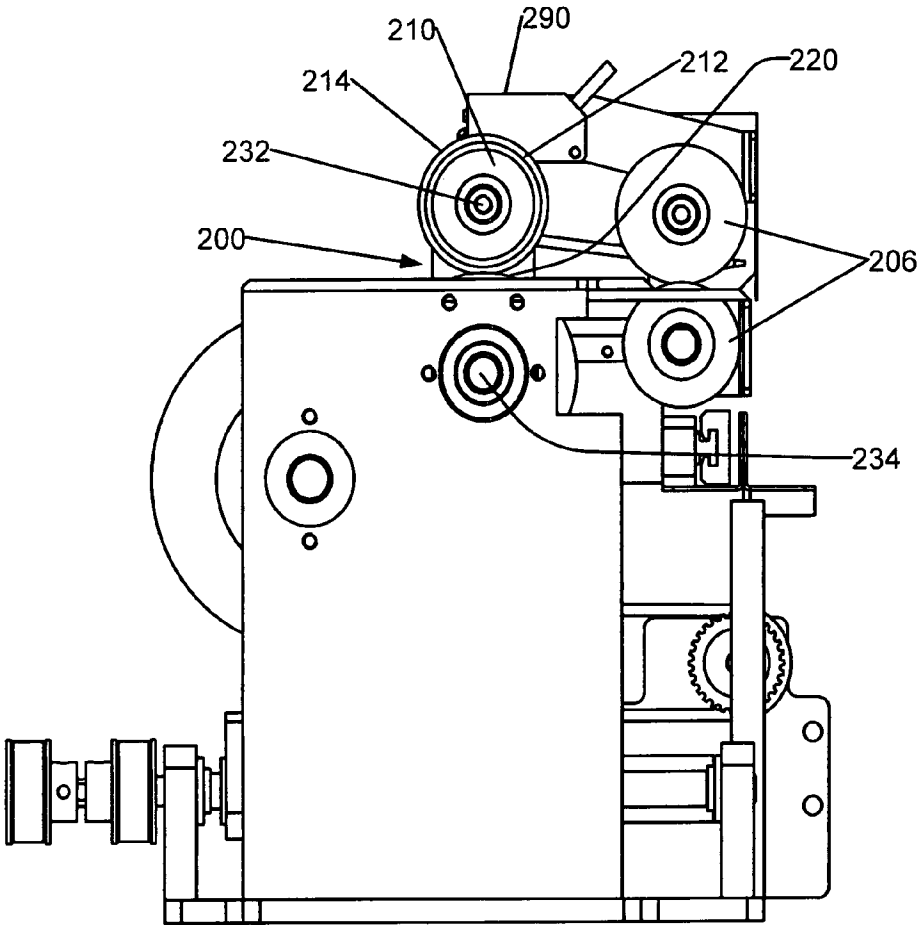
FIG. 4A illustrates a side view of the embodiment of the crease roller apparatus according to FIG. 2A.
Figure 4B:
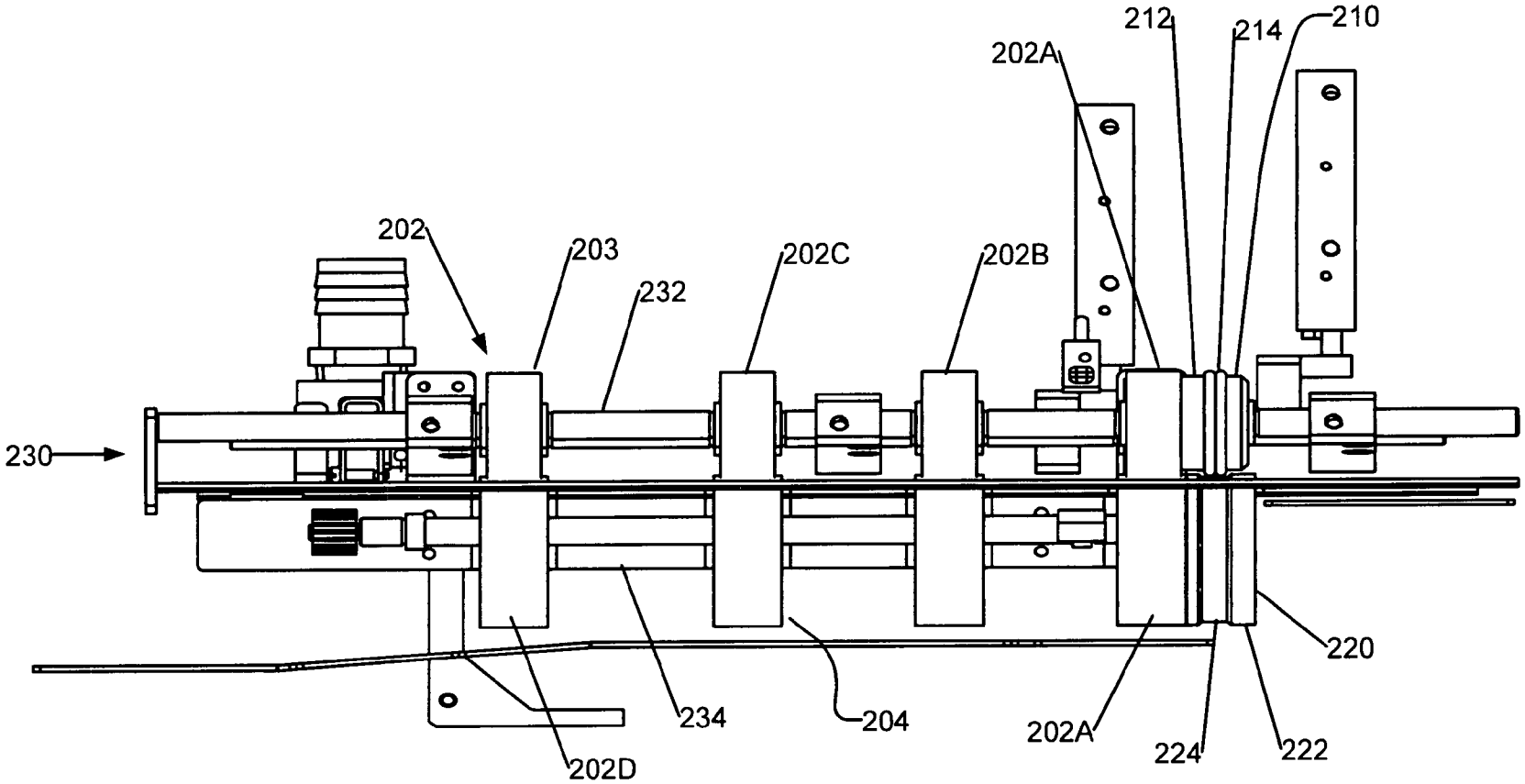
FIG. 4B illustrates a front view of the embodiment of the crease roller apparatus according to FIG. 2A.

FIGS. 2A and 2B illustrate the feeding of an envelope E into a staging position, generally designated as 460, within a variable envelope opener apparatus, generally designated as 400. Envelope E has a body portion BP and a flap F. A fold FL is created between body portion BP and flap F along a crease or hinge line HL. Body portion BP can have a face side FS on which an address window usually resides or an address is usually printed. Body portion BP also has a backside. The backside of the body portion BP is where flap F can be secured to body portion BP to close envelope E.

Staging position 460 corresponds to the position of the envelope whereby it is suitably oriented within variable envelope opener apparatus 400 in preparation for the insertion of materials and/or other sheet articles therein. Variable envelope opener apparatus 400 can operate to permit an envelope to be opened in different widths depending on the amount of insert material to be inserted into the envelope. As envelope E is fed into the variable envelope opener apparatus 400, the envelope E can pass through a crease roller apparatus 200 to help ensure flap F of envelope E entering variable envelope opener apparatus 400 does not interfere with the insertion of the insert material into envelope E. Once the insert material has been inserted into the envelope, the envelope is conveyed for further processing through the inserter system IS. For example, the filled envelope can then be conveyed into sealer module 700 as described above or can be diverted out of the inserter system IS in direction $C_2$ as shown in FIG. 1 if a defect or problem is detected with the envelope. More detail regarding envelope staging and feeding process is provided herein below.

Envelope E can be fed from the envelope feeder apparatus 100 (see FIG. 1) such that envelope E has face side FS of body portion BP of envelope E facing upward. Flap F of envelope E extends outward from hinge line HL away from body portion BP of envelope E. The first set of feed rollers 202 transports envelope E and, along with the second set of feed rollers 206, feed envelope E into registration apparatus 440 such that flap F resides on flap plate 446. A negative pressure can be created through housing 442 of registration apparatus 440 by vacuum connection 444 to register envelope E within registration apparatus 440. As shown in FIG. 2B, envelope E is, at this point, aligned under first drop bar 450 and second drop bar 452. First drop bar 450 and second drop bar 452 can be used to help push envelope E from staging position 460 into an insertion position. While envelope E is being fed by the sets of feed rollers 202, 206 into registration apparatus 440, crease roller apparatus 200 can score envelope E along the hinge line HL to bend flap F of envelope E in an inverted direction from that of the original fold along hinge line HL.

As seen in FIGS. 2A, 2B, 3, 4A, and 4B, the crease roller apparatus 200 can include a first roller 210 having a circumferential perimeter surface 212 disposed therearound. First roller 210 can include a ridge 214 that extends at least partially around circumferential perimeter surface 212. Crease roller apparatus 200 can also include a second roller 220 that also has a circumferential perimeter surface 222 disposed therearound. Circumferential perimeter surface 222 of second roller 220 can have a channel, or groove, 224 that extends at least partially around it. An alignment mechanism, generally designated as 230, can engage first roller 210 and second roller 220 so that circumferential perimeter surfaces 212, 222 of first roller 210 and second roller 220, respectively, are aligned to permit ridge 214 to reside and run within channel 224.

In the embodiment shown in FIGS. 2A, 2B, 3, 4A, and 4B, the alignment mechanism 230 includes an upper shaft 232 and a lower shaft 234 on which the set of feed rollers 202 reside. Each set of feed rollers can comprise pairs of rollers disposed on the respective shafts 232, 234. For example, the first set of feed rollers 202 can comprise pairs of rollers 202A, 202B, 202C, 202D. Each pair of feed rollers include upper rollers 203 and bottom rollers 204 that are aligned to receive and transport an envelope E therebetween when at least one of shafts 232, 234 is driven by a drive system 236 (e.g., a gear or pulley driven mechanism). The drive system can also be used to drive the second set of feed rollers 206. Within the embodiment shown, crease roller apparatus 202 can also be driven by drive system 236 since shafts 232, 234 make up at least a part of alignment mechanism 230 of crease roller apparatus 200. Alternatively, the second set of feed rollers and/or crease roller apparatus 200 can be driven by separate drive systems.

Different pairs of feed rollers 202A, 202B, 202C, 202D within the set of feed rollers 202 may be used depending on the size of the envelope being processed. However, the alignment of the hinge lines of the envelopes being process with the crease roller apparatus 200 should not change. For example, pairs of feed rollers 202A and 202B can be used to transport small sized envelopes such as normal letter envelopes, while the pairs of rollers 202C and 202D do not come in contact with the envelope. In contrast, when a flats envelope is being transported, all four sets of rollers 202A, 202B, 202C and 202D can be used to propel envelope E into the variable envelope opener apparatus 400. With any size envelope, the hinge line of the envelope is aligned with first roller 210 and second roller 220 of crease roller apparatus 200, so that the envelope is scored on or about the hinge line by ridge 214 of first roller 210 positioned and moving within channel 224 of second roller 220.

Figure 5:
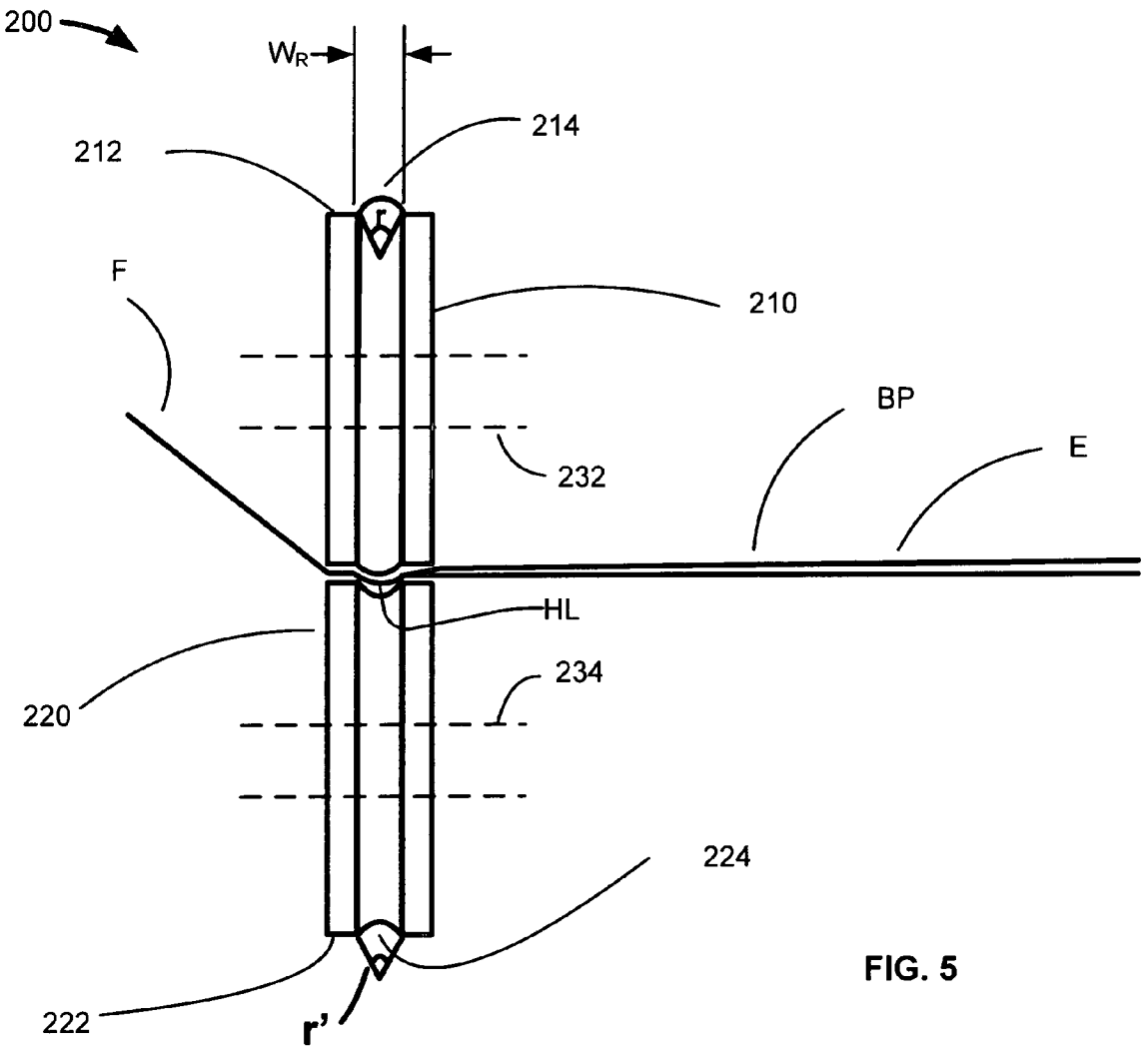
FIG. 5 illustrates a schematic view of an embodiment of a first roller and second roller used in a crease roller apparatus according to the present subject matter.

As can be seen in FIG. 5, envelope E can be passed between first roller 210 and second roller 220 such that hinge line HL of envelope E is scored by ridge 214 of first roller 210 within channel 224 of second roller 220. This scoring causes flap F of envelope E to turn upward opposite the direction the natural fold of hinge line HL. In this manner, envelope E including flap F will take on a more planar position after passing between crease rollers 210, 220. As shown in FIG. 5, ridge 214 can have a radius of curvature r that is substantially similar to a radius of curvature r' of channel 224.

Further, radius of curvature r of ridge 214 can be smaller than radius of curvature r' of channel 224. For example, the radius of curvature r of the ridge 214 can have a radius of curvature that is slightly less than the radius of curvature of channel 224 so that the side of ridge 214 do not contact the sides of channel 224. Still further, ridge 214 can be of a conical shape or the like such that its apex can make proximate contact with the hinge line HL upon contact with the envelope E. Similarly, the channel 224 can be of a conical shape oriented complementary or inversely to the conical shape of ridge. In other embodiments, channel 224 can be different in size and/or shape than ridge 214, so long as the envelope being scored is scored on or about its hinge line to cause the whole envelope to assume a more planar position. Ridge 214 can also have a width $W_R$ that is large enough to score along the hinge line, even if the envelope is misfed or is skewed.

Ridge 214 can be formed on a circumferential perimeter surface 212 of first roller 210 by molding, casting, or grinding and finishing of the roller as it is created. The material of the roller can be a metal or a hard plastic. Further, ridge 214 can be made of different material than the body of first roller 210. Such material can be more flexible than the material of the body of first roller 210. For example, ridge 214 can be formed by the placement of one or more o-rings on the outer surface of the circumferential perimeter 212 of the first roller 210. If an o-ring is used to form the ridge 214, a groove can be carved into the circumferential perimeter 214 of first roller 210 in which the o-ring can reside. The o-ring can be made of a flexible material that allows it to deform under the pressure created between first roller 210 and second roller 220.

Figure 6A:
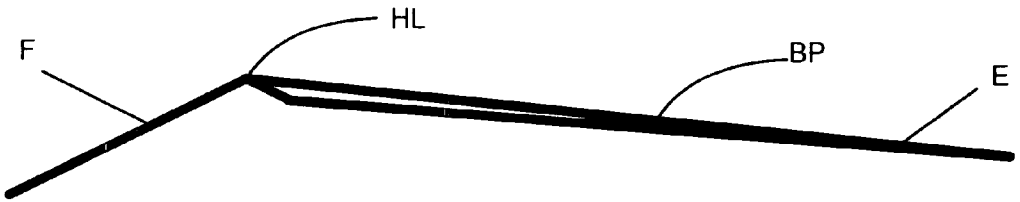
FIGS. 6A, 6B, and 6C illustrate schematic views of an envelope passing through an embodiment of a crease roller apparatus according to the present subject matter.
Figure 6B:
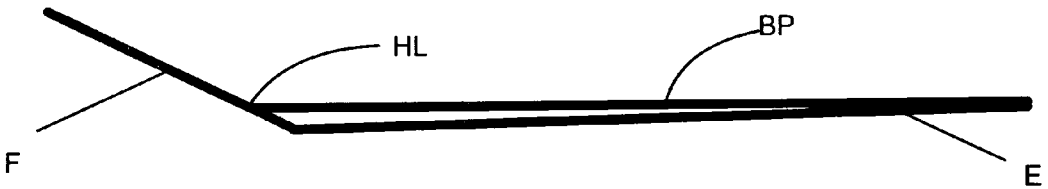
Figure 6C:
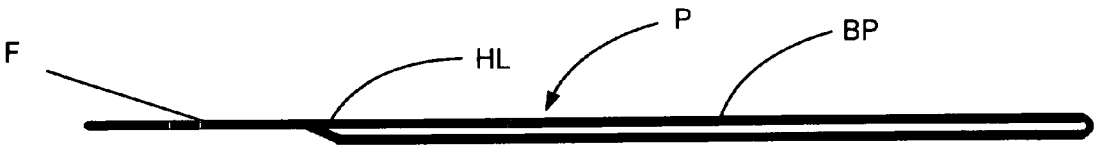

FIGS. 6A, 6B, and 6C provide a schematic view of an envelope E during processing through a crease roller apparatus. FIG. 6A illustrates envelope E before it is scored by the crease roller apparatus along its hinge line HL. Flap F of envelope E has a tendency to extend in the direction in which hinge line HL folds flap F. As envelope E runs through the crease roller apparatus, envelope E is bent about hinge line HL such that flap F is bent in the direction opposite of the natural fold direction that hinge line HL creates for flap F. Once envelope E exits the crease roller apparatus, the folding in the inverted direction of flap F along hinge line HL helps the envelope to assume a more planar position, generally designated as P, with envelope flap F and envelope body portion BP residing in substantially the same plane. In this manner, envelope E can be more easily filled with insert material without flap F extending in its natural folded position and interfering with the insertion of the insert material. This permits easier processing of envelope E within insert station 300.

Figure 7B:
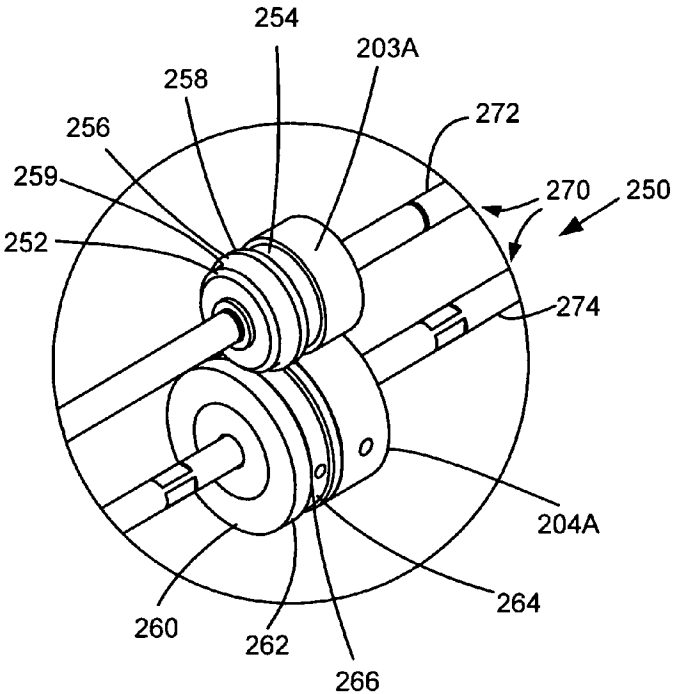
FIG. 7B illustrates a perspective view of the embodiment of a crease roller apparatus of FIG. 7A.
Figure 7A:
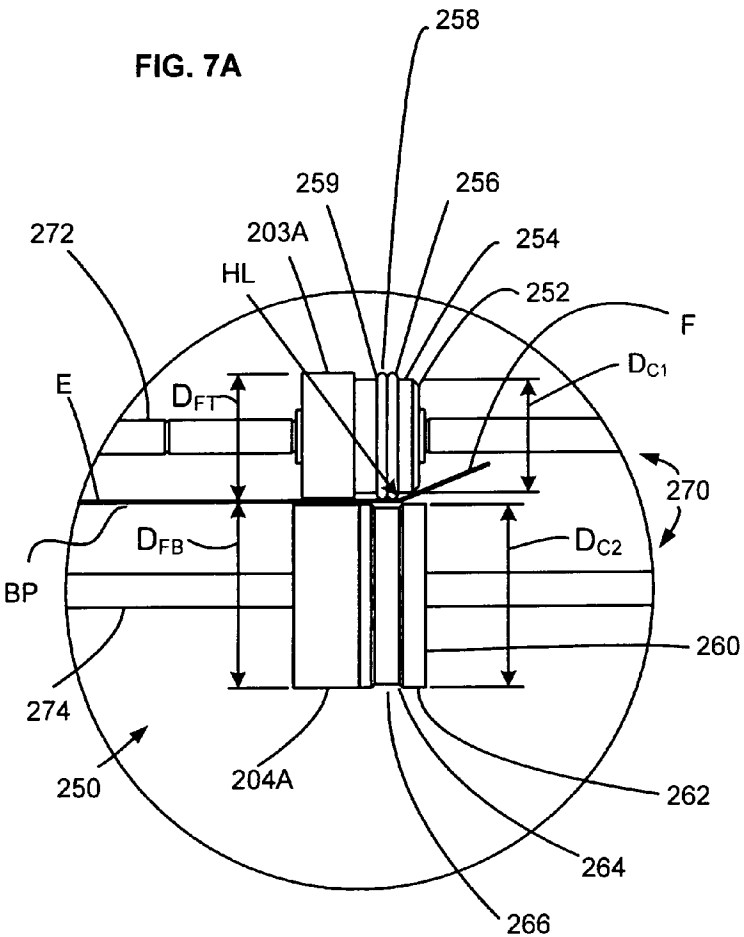
FIG. 7A illustrates a side view of a further embodiment of a crease roller apparatus according to the present subject matter.

FIGS. 7A and 7B illustrate a further embodiment of a crease roller apparatus, generally designated as 250. The crease roller apparatus 250 includes a first roller 252 having a circumferential perimeter surface 254 in which a groove is defined therein. A first o-ring 256 and a second o-ring 258 can be placed within the groove such that first o-ring 256 and second o-ring 258 form a ridge, generally designated as 259, extending around circumferential perimeter surface 254. The crease roller apparatus 250 can also include a second roller 260 having a circumferential perimeter surface 262 with a channel 264 defined therein. First roller 252 and second roller 260 can be aligned by an alignment mechanism generally designated as 270. Alignment mechanism 270 can include a first shaft 272 on which first roller 252 resides and a second shaft 274 on which second roller 260 resides. First shaft 272 and second shaft 274 can be the shafts on which the feed rollers reside, respectively. In this manner, the same mechanism that drives the feed rollers to transport envelope E into the variable envelope opener apparatus can also drive crease roller apparatus 250. Alternatively, alignment mechanism 270 can comprise a separate set of shafts and a separate drive system for crease rollers 252, 260 than that of the feed rollers. First roller 252 can be placed against a top feed roller 203A, while second roller 260 can be aligned against a bottom feed roller 204A. First roller 252 and second roller 260 are aligned so that ridge 259 formed by first o-ring 256 and second o-ring 258 engages channel 264 such that ridge 259 and channel 264 bend envelope E as it passes between them along hinge line HL of envelope E.

As shown in FIG. 7A, first roller 252 can have a diameter $D_{C1}$ and second roller 260 can have a diameter $D_{C2}$. Diameter $D_{C1}$ of first roller 252 can be less than a diameter $D_{FT}$ of top feed roller 203A. At the same time, ridge 259 extends past both diameter $D_{FT}$ of top feed roller 203A and diameter $D_{C1}$ of first roller 252 such that first O-ring 256 and second O-ring 258 extend to a base 266 of channel 264 of second roller 260 to permit first O-ring 256 and second O-ring 258 and channel 264 to engage an envelope E that passes therebetween. Second roller 260 can have a diameter $D_{C2}$ that is about equal to diameter $D_{FB}$ of bottom feed roller 204A. By having first roller 252 with a diameter less than feed roller 203A, while ridge 259 of the first roller 252 extends past the diameter $D_{FT}$ of the feed roller 203A such that first O-ring 256 and the second O-ring ridge 258 extends to base 266 of channel 264, the only substantial contact to envelope E made by crease roller apparatus 250 can be by O-rings 256 and 258 running within channel 264. In this manner, crease roller apparatus 250 only pressingly engages envelope E on or about hinge line HL. First and second O-rings 256, 258 are wide enough and can be slightly deformed when contacting base 266 of channel 264 so that the hinge line of envelope E passing therebetween is scored, even if envelope E is skewed during feeding.

As shown in FIGS. 7A and 7B, first roller 252 can reside on first shaft 272 against top feed roller 203A, while second roller 260 can reside on second shaft 274 against bottom feeder roller 204A. In this manner, when the envelope is being scored by ridge 259 within channel groove 264, body portion BP of the envelope E can be held down by feed rollers 203A, 204A, while flap F is bent in an inverted direction to that of the original fold of hinge line HL on or about hinge line HL. As mentioned above, the crease roller apparatus 250 can be power driven. For example, either or both shafts 272, 274 on which first roller 252 and second roller 260 reside can be driven by a belt and pulley system rotated by a motor.

Further, as seen in FIGS. 2A and 2B, 3, and 4A first shafts 232 can include one or more envelope guides 280 that also can help prevent the curling of the envelope as it is being scored by crease roller apparatuses 200. Each envelope guide 280 can include a stem 282 and a clamp lock 284. Each clamp lock 284 secures a stem 282 of an envelope guide 280 to first shaft 232. Each clamp lock 284 allows its envelope guide 280 to be secured in a stationary position even while first shaft 232 is permitted to rotate. Each clamp lock 284 permits an envelope guide 280 to change its stationary position depending on the angle at which it is desired for stem 282 to extend. Preferably, each clamp lock 284 holds a stem 282 in a downward position from the first shaft 232 so that the stem 282 extends under a shaft 208 of the second set of feed rollers 206 that feeds the envelope into registration apparatus 440 of variable envelope opener apparatus 400. In this manner, stems 282 of the envelope guides 280 direct the envelope so that the envelope leaving the first set of feed rollers 202 and crease roller apparatus 200 will be easily grabbed by the second set of feed rollers 206 during and after the scoring of the hinge line of the envelope. While passing through crease roller apparatus 200, the envelope tends to bow upward, especially at the flap F (see FIG. 6B). The envelope guides 280 redirect the bowed envelope towards the nips between the top and bottom rollers of the second set of rollers 206. Thereby, the envelope is fed through the sets of feed rollers 202, 206 and scored by crease roller apparatus 200 and then feed into registration apparatus 440.

A sensor 290 can be included proximal to feed rollers 202, 206 and crease roller apparatus 200. Sensor 290 can be used to sense the presence of an envelope being transported into variable envelope apparatus 400. The information collected by such a sensor can be sent to controller 600 to aid in the controlling of inserter system IS. Sensor 290 can be a contact sensor, an electromagnetic sensor, an optical sensor, or the like.

After the envelope has been scored by crease roll apparatus 200, the envelope can be fed into registration apparatus 440 for registering within variable envelope opener apparatus 400. As can be seen in FIG. 2B, crease roll apparatus 200 and the set of feed rollers 202, 206 are aligned to feed the envelope along direction A so that the rear end of the envelope resides in registration apparatus 440 and the flap end of the envelope resides on flap plate 446, thereby holding the envelope in a staging position 460. As a means of further stabilization of the envelope in the staging position, the registration apparatus can include housing 442 for receiving a portion of the envelope and a vacuum connection 444 associated therewith for providing a negative pressure within housing 442 from a vacuum source that aligns the envelope within the housing 442. Once the envelope is received within staging position 460, first drop bar 450 and second drop bar 452 can be readied to push the envelope out of staging position 460 and into the insertion position within variable envelope opener apparatus 400.

Those skilled in the art will recognize that various other embodiments of the invention may be contemplated without limiting the scope of the teachings herein. Indeed, the crease roller apparatus 200 described herein may enable faster and more reliable processing of sheet articles by causing the sheet articles to assume a more planar position within the sheet or mail processing machine. While described in conjunction with a variable envelope opener apparatus, crease roller apparatus 200, described herein, can be used in any envelope handling apparatus. For example, the crease roller apparatus 200 can be a stand alone machine used to straighten envelopes after their creation. The utility of crease roller apparatus 200 is not limited to the processes described here in the context of examples of its use. Further, crease roller apparatus 200 can be used in conjunction with other creased sheet articles.

Also, while described in conjunction with a variable envelope opener apparatus, registration apparatus 440, described herein, can be used in any sheet or envelope handling apparatus. The registration apparatus only needs a housing into which sheets or envelopes can enter and a suitable stabilization mechanism (e.g., vacuum connection that provides a negative pressure to the housing to register the sheets or envelopes). For example, the registration apparatus can be in another location within a sheet processing machine, wherein folded sheets pass through a slit in the registration housing. As the folded sheets are passing through the slit, a negative pressure can pull the folded sheets against the housing to register the folded sheets. The utility of registration apparatus is not limited to the processes described here in the context of examples used.

The embodiments of the present disclosure shown in the drawings and described above are exemplary of numerous embodiments that can be made within the scope of the appending claims. It is contemplated that the configurations for crease roller apparatuses within a sheet processing machine can comprise numerous configurations other than those specifically disclosed. The scope of a patent issuing from this disclosure will be defined by the appended claims.

What is claimed is:

1. An envelope crease roller apparatus for bending a crease of an envelope in a direction opposite to that of an original fold of the crease, the apparatus comprising:

(a) an envelope path for passage between first and second rollers of a portion of an envelope with an elongated crease and a flap extending from the crease;

(b) the first roller having a circumferential perimeter surface, the first roller having a ridge extending at least partially around the circumferential perimeter surface of the first roller;

(c) the second roller having a circumferential perimeter surface, the second roller having a channel extending at least partially around the circumferential perimeter surface of the second roller; and (d) the first and second rollers being oriented to align the circumferential perimeter surface of the first roller with the circumferential perimeter surface of the second roller wherein the ridge of the first roller extends into the channel of the second roller, and the first and second rollers being oriented relative to the envelope and envelope path to pass the elongated crease of the envelope between the ridge of the first roller and the channel of the second roller along the crease such that the first and second rollers bend the crease of the envelope in an inverted direction to that of an original fold of the crease so that the envelope assumes a planar position.

2. The crease roller apparatus according to claim 1, wherein the ridge on the first roller comprises at least one O-ring disposed around the circumferential perimeter surface of the first roller.

3. The crease roller apparatus according to claim 1, comprising a first shaft engaging the first roller and a second shaft engaging the second roller.

4. The crease roller apparatus according to claim 3, wherein at least one of the first shaft or the second shaft is power driven.

5. The crease roller apparatus according to claim 4, wherein the first shaft and the second shaft have feed rollers disposed thereon that are configured to transport envelopes.

6. The crease roller apparatus according to claim 1, wherein the ridge of the first roller has a curvature.

7. The crease roller apparatus according to claim 6, wherein the channel of the second roller has a curvature that is slightly greater than the curvature of the ridge of the first roller.

8. The crease roller apparatus according to claim 1, wherein the ridge of the first roller is positioned to engage the channel of the second roller when the ridge extends into the channel.

9. The crease roller apparatus according to claim 8, wherein, of the first and second rollers, only the ridge of the first roller and the channel of the second roller is configured to engage the envelope.

10. A method for bending a crease of a sheet article in a direction opposite to that of an original fold of the crease, the method comprising the steps of:

(a) providing a sheet article with a crease; and (b) feeding the sheet article between a pair of rollers where only the crease passes between a ridge of a first roller and a channel of a second roller along the crease to bend the crease of the sheet article such that the first and second rollers bend the crease of the sheet article in an inverted direction to that of an original fold of the crease so that the sheet article assumes a planar position.

11. The method according to claim 10, wherein the ridge of the first roller extends around a circumferential perimeter surface of the first roller and the channel of the second roller is within a circumferential perimeter surface of the second roller, and wherein feeding the sheet article between the rollers comprises feeding the crease of the sheet article between the ridge and the channel wherein the ridge extends at least partially into the channel.

12. The method according to claim 11, wherein the sheet article comprises an envelope and wherein step (b) comprises feeding the envelope between the rollers where the crease is fed between the ridge and the channel to bend the crease.

13. The method according to claim 11, wherein the rollers score the sheet article along the crease.

14. The method according to claim 10, wherein the rollers bend the crease of the sheet article such that the sheet article assumes a planar position.

15. The method according to claim 10, wherein the sheet article is an envelope.

16. A method for bending a crease of a sheet article in a direction opposite to that of an original fold of the crease, the method comprising the steps of:

(a) providing a sheet article with a crease comprising a hinge line; and (b) feeding the sheet article between a pair of rollers where the crease passes between a ridge of a first roller and a channel of a second roller along the crease to bend the hinge line of the sheet article in an inverted direction to that of an original fold of the hinge line such that the sheet article assumes a planar position.

17. A method for bending a flap of an envelope in a direction opposite to that of a flap fold in the envelope, the method comprising the steps of:

(a) providing an envelope in an open position with a flap extending from a flap fold along a hinge line of the envelope extended;

b aligning the envelope to pass between rollers with the hinge line of the envelope aligned to pass between the rollers; and c passing the hinge line of the envelope between the rollers to bend the hinge line in an inverted direction to that of the flap fold.

18. The crease roller apparatus according to claim 1, further comprising at least one guide disposed adjacent the first roller, the guide including a stem configured to redirect a sheet for further processing after passing between the ridge of the first roller and the channel of the second roller.

* * * * *